US005632191A

United States Patent [19]

Lemaire et al.

[11] Patent Number: 5,632,191

[45] Date of Patent: May 27, 1997

[54] PISTON ROLLER ALIGNMENT CONFIGURATION FOR A RADIAL PISTON MECHANISM

[75] Inventors: Gilles Lemaire, Margny-les-Compiègne; Alain Noel, Verberie, both of France

[73] Assignee: Poclain Hydraulics, France

[21] Appl. No.: 556,647

[22] Filed: Nov. 13, 1995

[30] Foreign Application Priority Data

Nov. 30, 1994 [FR] France ..... 94 14361

[51] Int. Cl.[6] ..... F04B 1/107; F16J 1/10

[52] U.S. Cl. ..... 91/491; 417/273; 417/462; 92/72; 92/165 R; 92/165 PR

[58] Field of Search ..... 417/273, 462; 91/491, 498; 92/72, 165 R, 165 PR

[56] References Cited

U.S. PATENT DOCUMENTS

| | | | |
|---|---|---|---|
| 4,719,843 | 1/1988 | Noel | 91/491 X |
| 4,747,339 | 5/1988 | Wüsthof et al. | 92/72 X |
| 5,081,906 | 1/1992 | Lemaire et al. | 417/273 X |

FOREIGN PATENT DOCUMENTS

| | | | |
|---|---|---|---|
| 191674 | 8/1986 | European Pat. Off. | 91/491 |
| 3530979 | 3/1987 | Germany | 91/491 |

*Primary Examiner*—Timothy Thorpe
*Assistant Examiner*—Roland G. McAndrews, Jr.
*Attorney, Agent, or Firm*—Ladas & Parry

[57] ABSTRACT

The invention relates to a hydraulic mechanism comprising: a cam; a cylinder block; cylinders formed in the cylinder block; pistons slidably mounted in the cylinders; thrust rollers for the pistons acting on the cam and axially defined by two transverse faces; two wedging parts for each roller, each wedging part being disposed in a recess between the end face of the roller and the inside face of the cylinder, thereby holding the roller in position, one of the wedging parts extending to the bottom portion of the recess and including a groove parallel to the axis of the piston, and a projection that is fixed relative to the cylinder being received in the groove. According to the invention, a hole formed in the cylinder block opens out into its peripheral face and a generally U-shaped part having two branches is mounted on the cylinder block by inserting a first branch thereof in the hole and by fixing the first branch relative to the cylinder block, its second branch being inserted in the groove and constituting said projection, the web of the U-shape overlying the peripheral face. An application of the invention lies in making a hydraulic motor that is reliable and that is of reduced manufacturing cost.

14 Claims, 3 Drawing Sheets

PISTON ROLLER ALIGNMENT CONFIGURATION FOR A RADIAL PISTON MECHANISM

FIELD OF THE INVENTION

U.S. Pat. No. 5,081,906 describes and shows a hydraulic motor or pump mechanism comprising: a cam; a cylinder block mounted to rotate relative to the cam about an axis of rotation; at least one cylinder formed in the cylinder block; at least as many pistons as there are cylinders, each piston being slidably mounted inside a cylinder along a piston slide axis; as many piston thrust rollers for rolling on the cam as there are pistons, each roller being axially defined by two transverse end faces and being mounted on a piston via a rotary bearing to rotate about a roller axis perpendicular to the sliding axis of said piston, the roller being suitable for penetrating, at least in part, into the cylinder in which the piston is slidably mounted, the end of the piston in which the rotary bearing for the roller is mounted including two recesses each corresponding to at least one space extending between at least the cylindrical surface of the roller, the cylindrical surface, and one of the transverse faces of the roller, said space being open to the top portion of the piston at least in the zone where the cylindrical surface of the roller is disposed projecting beyond the piston; and two wedging parts for each roller, each of which parts is disposed in one of said two recesses between the corresponding face of the roller and the inside face of the cylinder on which said wedging part bears, so as to hold the roller in position axially parallel to its axis of rotation while firstly at least one of the two wedging parts extends on the axis of the piston as far as the bottom portion of the recess so that in the direction of the piston leaving the cylinder it is displaced together with said piston, and secondly said wedging part includes a groove which extends parallel to the axis of the piston and which opens out into the face of said wedging part opposite from the corresponding end face of the roller, a projection that is fixed relative to the cylinder for rotation about the axis of the piston, and that is disposed projecting relative to said cylinder, being inserted in said groove so as to leave said wedging part free to move in translation relative to the cylinder parallel to the axis of the piston.

BACKGROUND OF THE INVENTION

In the state of the art, firstly the projection is secured relative to the cylinder block by being fixed from or along a transverse end face of the cylinder block, and secondly, in some embodiments, the projection passes through the wall of the cylinder block between said transverse end face and the inside of the corresponding cylinder.

It should be observed that technique suffers from certain drawbacks. In particular, the transverse end face of the cylinder block is not always easily accessible, particularly for intermediate rows of cylinders in motors having three or more parallel rows of cylinders. Further, the known embodiment in which the projection passes through the wall of the cylinder block requires holes to be provided in the cylinders themselves and that does not constitute the best possible disposition.

OBJECTS AND SUMMARY OF THE INVENTION

The invention seeks to remedy the above drawbacks, and to this end it provides, in the above-described mechanism, that a hole formed in the cylinder block opens out into a peripheral face thereof, while a part that is generally U-shaped having a first branch and a second branch interconnected by a web of the U-shape is mounted on the cylinder block by inserting said first branch in said hole and by fixing said first branch relative to the cylinder block by fixing means, said second branch being inserted into the groove included in said wedging part and constituting said projection, said web of the U-shape being placed over said periphery of the cylinder block.

In addition, it is preferable to adopt the following advantageous disposition: the first branch of the U-shape possesses, prior to insertion in the hole of the cylinder block, a determined transverse dimension that is greater than the direction of said hole in a determined transverse direction, said fixing means being constituted by the clamping that exists between the first branch and the wall of the hole after insertion of said first branch in the hole which puts said determined transverse dimension of the first branch of the U-shape substantially into coincidence with said determined transverse direction of the hole.

In a first embodiment, the first branch of the U-shape is in the form of an open ring and is made of a resilient material, one of the transverse dimensions of the ring, prior to its insertion in the hole of the cylinder block, constituting said determined transverse dimension. The ring is preferably made of metal.

In a second embodiment, the first branch of the U-shape is provided with teeth whose ends coincide with said determined transverse dimension, and having the function of securing said first branch in the wall of said hole. Preferably, the first branch is shaped as a plane strip defined by two opposite edges each provided with said teeth.

Finally, in a third embodiment, the first branch of the U-shape includes a core and a core-covering body made of a material having a small modulus of elasticity, the modulus of elasticity of said material preferably being not more than 10,000 mega Pascals.

Advantageously, firstly said hole is cylindrical having an axis that is substantially radial relative to the axis of rotation of the cylinder block and of determined diameter, and secondly said body is likewise substantially cylindrical and possesses a diameter which, prior to insertion of the first branch of the U-shape into the hole is greater than the determined diameter of the hole; also, said core is shaped as a plane strip defined by two opposite edges, each edge being provided with indentations for securing said core-covering body.

Generally, and also in the first and second embodiments, said hole is cylindrical, its axis being substantially radial relative to the axis of rotation of the cylinder block, with the axis of the cylindrical hole preferably lying in the radial plane containing the axis of rotation of the cylinder block, and the sliding axis of the piston.

The main advantage of the invention is the new possibility firstly of achieving immobilization of the piston relative to rotation about the axis of the cylinder in simple manner even for intermediate rows of cylinders, and secondly of achieving such immobilization while not passing through the wall of the cylinder.

BRIEF DESCRIPTION OF THE DRAWINGS

The invention will be better understood and secondary characteristics and the advantages thereof will appear on reading the following description of embodiments given by way of example.

Naturally the description and the drawings are given purely by way of non-limiting indication.

Figure 1:
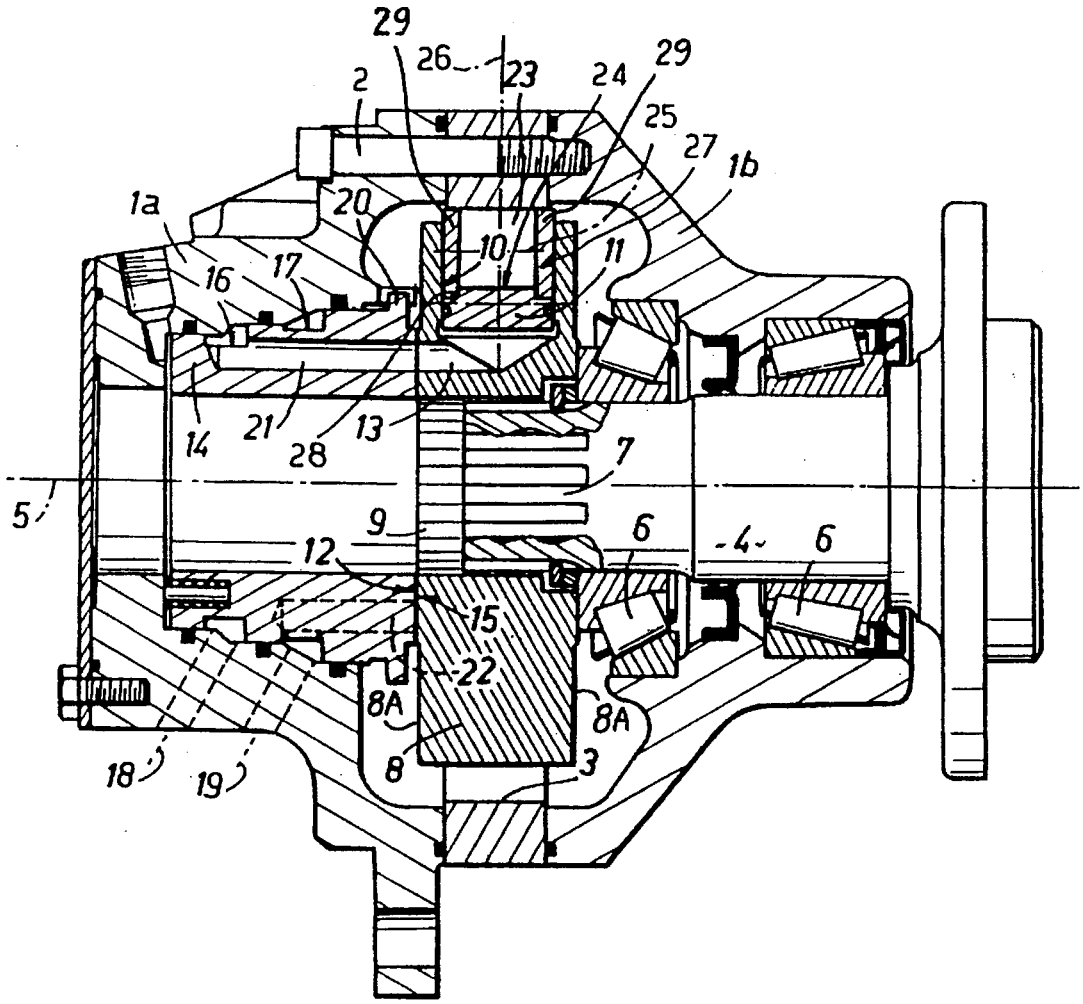
Figure 2:
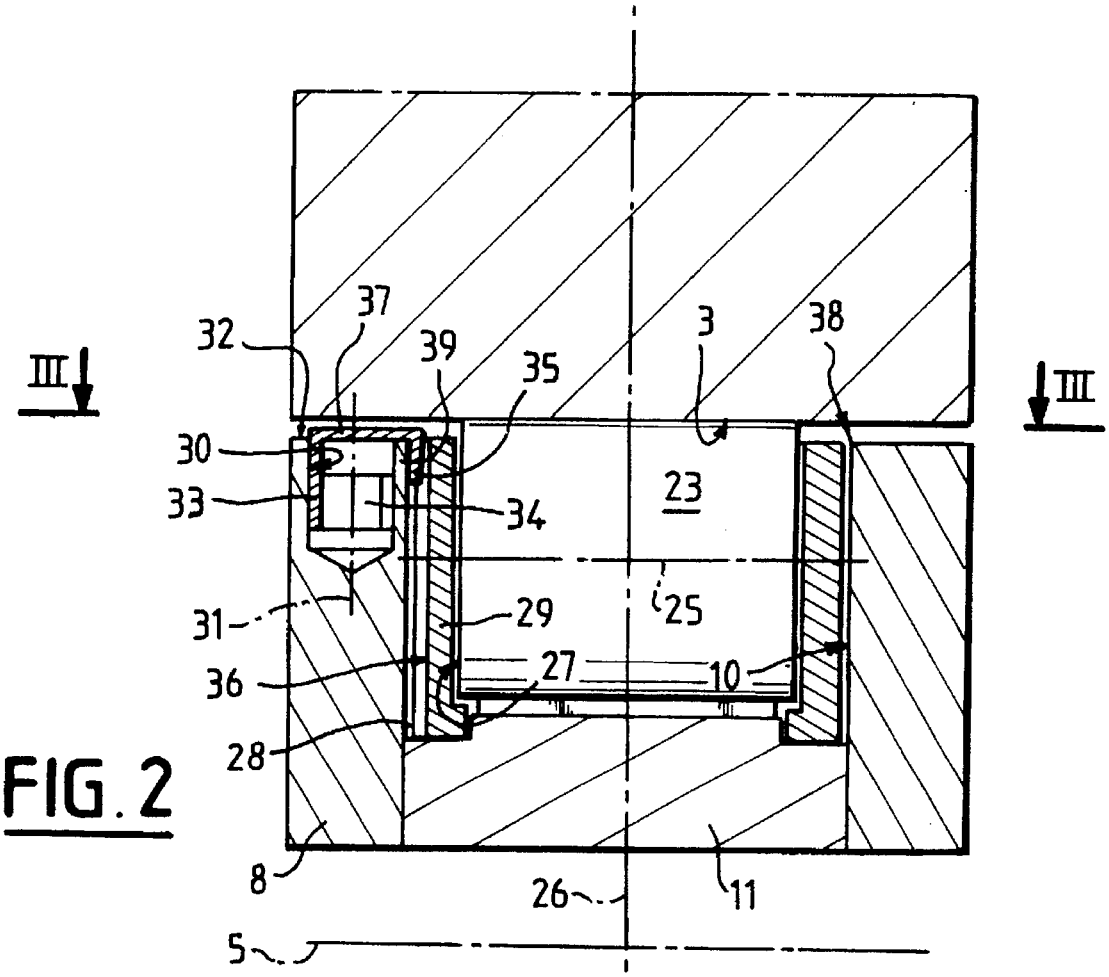
Figure 3:
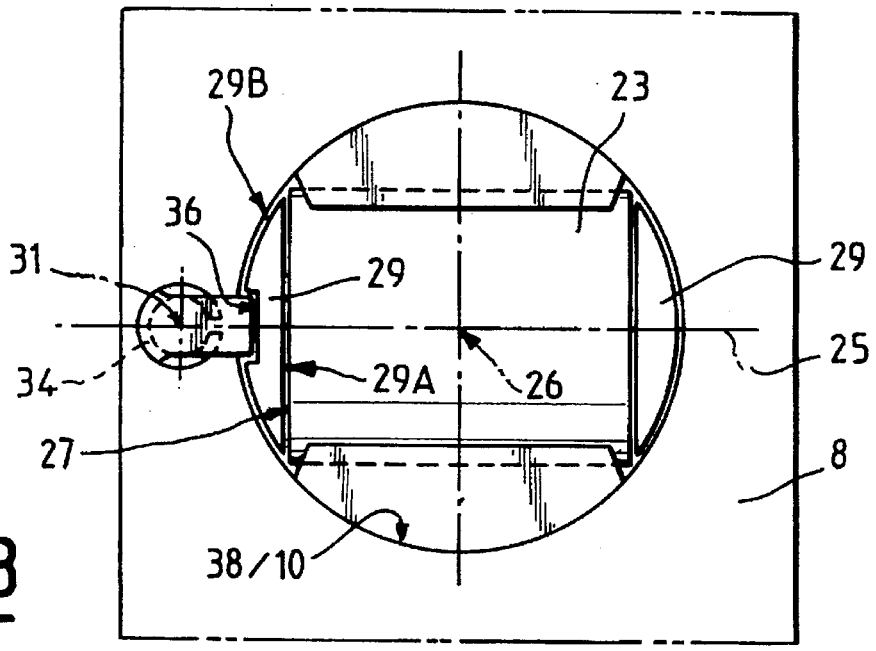
Figure 4:
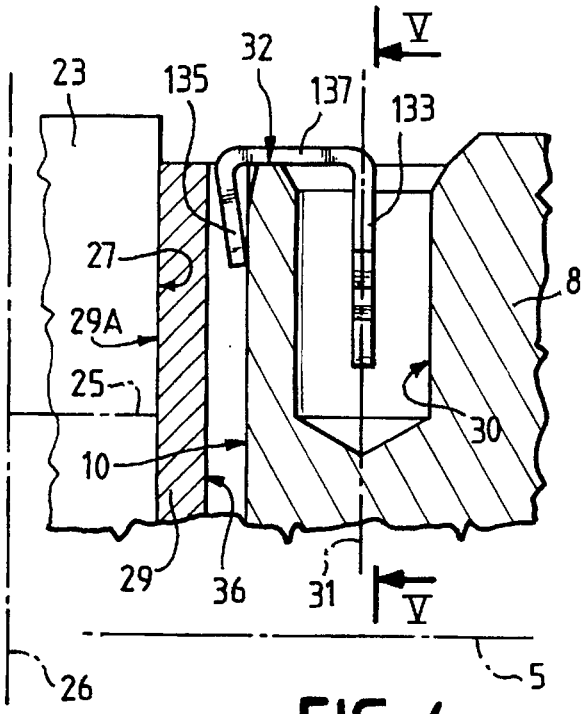
Figure 5:
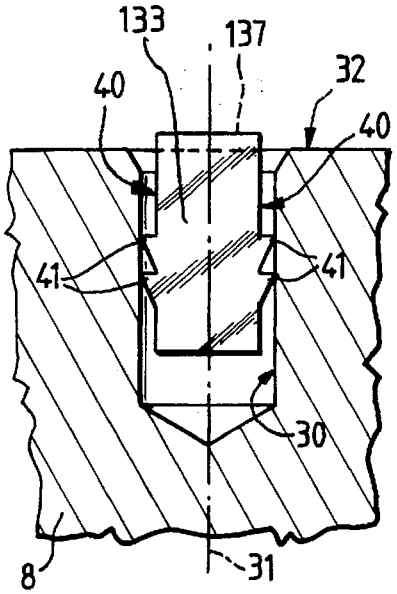
Figure 6:
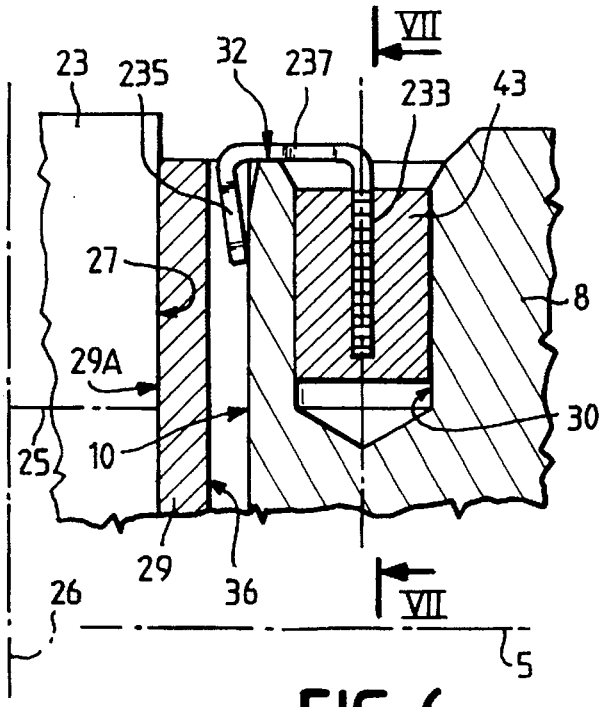
Figure 7:
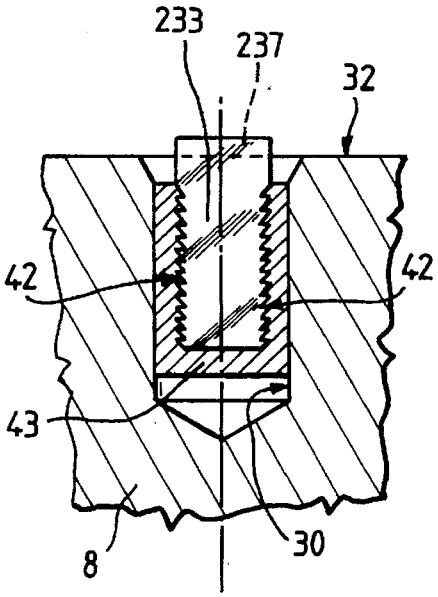

Reference is made to the accompanying drawings, in which:

FIG. 1 is an axial section through a hydraulic motor of the invention;

FIG. 2 is a section on the plane containing the axis of rotation and the axis of one of the cylinders in the motor of FIG. 1;

FIG. 3 is a view on III—III of FIG. 2;

FIG. 4 is a section analogous to that of FIG. 2, showing a second embodiment of the motor of the invention;

FIG. 5 is a section on V—V of FIG. 4;

FIG. 6 is a section analogous to that of FIG. 2, showing a third embodiment of the motor of the invention; and FIG. 7 is a section on VII—VII of FIG. 6.

MORE DETAILED DESCRIPTION

The motor of FIG. 1 is constituted by:

a two-part case 1*a*, 1*b* held together by screws 2;

a corrugated cam 3 secured to the case 1*a*, 1*b;* an outlet shaft 4 mounted to rotate relative to the case about an axis 5, by means of two roller bearings 6, with an inside end thereof being provided with fluting 7;

a cylinder block 8 having a central opening provided with fluting 9 matching the fluting 7 on the shaft so as to constrain the shaft 4 to rotate with the cylinder block 8, and so as to center the cylinder block relative to the shaft;

a plurality of cylinders 10 disposed radially in a star configuration relative to the axis 5, each including a piston 11 that is slidably mounted therein;

a plane face 12 that is provided on the cylinder block 8 and that is perpendicular to the axis of rotation 5, into which there open out ducts 13 that are connected to the various cylinders 10; and a dispenser 14 for dispensing fluids to the various cylinders 10; which dispenser is provided with a plane face 15 perpendicular to the axis of rotation 5 and disposed facing and bearing against the face 12 of the cylinder block, and which includes two circular grooves 16 and 17 that communicate respectively and selectively with a source of fluid under pressure 18 and with a tank of fluid having no pressure 19, while a device 20 having a lug and a bracket constrains the fluid distributor 14 to rotate with the portion 1*a* of the case, and ducts 21, 22 connect the grooves 16 and 17 respectively to the plane face 15 and are suitable for being put into communication in succession with the ducts 13 of the cylinder block during relative rotation between the cylinder block 8 and the distributor 14.

A cylindrical roller 23 is received in a bearing 24 provided at the end of each piston 11 and is mounted to rotate about a roller axis 25 orthogonal to the piston axis 26 that coincides with the axis of the cylinder 10 and that bears against the cam 3. The roller 23 is suitable for penetrating at least in part into the cylinder so that adjacent to each transverse face 27 defining the roller there is a recess 28 provided in the portion of the piston 11 that supports the roller, thereby making it possible to provide spaces on either side of said roller. Each recess corresponds to at least one space extending between at least the surface of the cylinder 10, the cylindrical surface of the roller 23, and the corresponding transverse surface 27 of the roller, said space also being open at the top portion of the piston, at least in the zone where the roller is disposed to project beyond the piston.

The above-described dispositions are to be found in each of the embodiments shown. In the embodiments shown, the plane perpendicular to the axis 25 of the roller 23 and containing the axis 26 of the piston is a plane of symmetry for the piston 11, the bearing 24, the roller 23, and said two spaces. It is also possible in the context of the invention to have a disposition that is asymmetrical in which the spaces are not symmetrical to each other about the plane perpendicular to the axis 25 of the roller.

In each embodiment, provision should be made for means that hold the roller 23 mounted on a piston 11 axially in position within its bearing 24 and that maintain its angular orientation relative to the axis 26 of the piston constant so as to ensure that the roller 23 is placed facing the cam 3 and is properly oriented relative to the cam so as to be capable of rolling on the cam. The means that are provided for achieving this end differ between embodiments and are described below.

In the embodiments of FIGS. 2 to 7, each space defined between a recess 28 of the piston 11 and the inside wall of the cylinder 10 contains a wedging part 29 of corresponding shape having a cross-section that is substantially cresent-shaped (FIG. 3). This wedging part 29 has a plane face 29A facing one of the end faces 27 of the roller 23, and a cylindrical face 29B bearing against the inside face of the cylinder 10 and thus providing axial wedging to the roller in the direction that causes the face 27 of the roller to bear against the face 29A of the part 29.

In the embodiment of FIGS. 2 and 3, one of the wedging parts 29 has a groove 36 extending parallel to the axis 26 of the piston (and also of the cylinder), and opening out into the top face of the wedging part 29. A blind cylindrical hole 30 is formed in the cylinder block having a radial axis 31 contained in the plane containing both the axis 26 of the piston and the axis 5 of rotation, and it opens out into the peripheral face 32 of the cylinder block 8 which is cylindrical about the axis 5. A staple, made of metal in the present example, (e.g. steel) is provided and is generally U-shaped with two branches being realized from a strip bent into a U-shaped configuration. The first branch 33 of the U-shape has a substantially cylindrical open ring 34 at one end with the outside diameter thereof prior to insertion into the hole 30 being slightly greater than the diameter of said hole 30. The ring 34 is inserted in the hole 30 in which it remains fixed by resilient deformation of said ring, which ring is advantageously made of steel. The second branch 35 of the U-shape is contained within the cylinder 10 and in the groove 36 of the wedging part 29, and it enables said wedging part 29 to slide parallel to the axis 26 of the piston. Finally, the web 37 of the U-shape overlies the peripheral face 32 of the cylinder block. It should be observed that the hole 30 is adjacent to the opening 38 of the cylinder 10, being separated therefrom only by a thin wall 39.

In the embodiment of FIGS. 4 and 5, only the shape and the structure of the staple are changed relative to the embodiment of FIGS. 2 and 3. The first branch 133 of the U-shape is flat and is defined by two substantially parallel opposite edges 40 that are provided with teeth 41 suitable for engaging the walls of the hole 30 after being inserted therein. The distance between points belonging to different edges 40 prior to insertion of the first branch 133 into the hole 30 is greater than the diameter of said hole. Insertion is achieved by forcing the branch into the hole. As in the embodiment of FIGS. 2 and 3, the second branch 135 of the U-shape is situated inside the cylinder 10, and it is contained in the groove 36 of the wedging part 29, enabling it to slide parallel to the axis 26 of the piston. Finally, the web 137 of the U-shape is placed over the peripheral face 32 of the cylinder block 8.

In the embodiment of FIGS. 6 and 7, only the shape and the structure of the first branch of the staple differs from those of the embodiments of FIGS. 2 and 3. The staple is U-shaped, having a metal core made of steel. The core 233 of the first branch of the U-shape is defined by two substantially parallel edges provided with indentations 42 that are spaced apart from each other by a width that is smaller than the diameter of the hole 30. This portion of the core is coated in a cylindrical stud 43 made of a material whose modulus of elasticity is small, e.g. a plastics material having a modulus of elasticity that is no greater than 10,000 mega Pascals. Prior to insertion in the hole 30, the diameter of the stud 43 is slightly greater than the diameter of the hole 30. The second branch 235 of the U-shape is situated inside the cylinder 10 and is contained in the groove 36 of the wedging part 29, enabling it to slide parallel to the axis 26 of the piston. Finally, the web 237 of the U-shape lies over the peripheral face 32 of the cylinder block 8.

In all three embodiments described, the first branch 33; 133; 233–43 of the U-shape is of defined transverse size—diameter of the ring 34 while in the free state, spacing between opposite teeth 41, or diameter of the stud 43—which size is greater than the diameter of the hole 30, and more generally is greater than the transverse size of the hole in a determined transverse direction in the more general case where the hole 30 need not necessarily be circularly cylindrical. Each time the first branch is fixed in the hole 30 by being a force-fit due to said determined transverse dimension of the first branch (33; 133; 233–43) of the U-shape being put substantially into coincidence with the determined transverse direction of the hole 30.

The ring 34 which is made of steel in this case is somewhat resilient so as to enable insertion into the hole 30 and then enable it to be held in position inside the hole.

In each of the embodiments shown, the staple is held relative to the cylinder block 8 and consequently relative to the cylinder 10, and it is therefore suitable for holding the piston 11 and the roller 23 in a determined orientation relative to the axis 26 of the piston, thus enabling the roller 23 to be held in a satisfactory position relative to the cam 3.

It should be observed that the hole 30 may be made anywhere in the peripheral face 32 of the cylinder block 8, and in particular in locations that are remote from the end transverse faces 8A of said cylinder block, in particular it may be in the vicinity of the cylinders in an inner row of cylinders of a motor having three or more parallel rows of cylinders. In addition, since the hole 30 has a radial direction (axis 31 passing substantially through the axis of rotation 5), the staple is fixed without making a through hole in the wall of the cylinder 10 so the cylinder is not damaged. It should also be observed that it is easy to make radial holes while making a cylinder block having radially opposite cylinders.

The invention is not limited to the embodiments described, but on the contrary it extends to any variant that may be provided thereto without going beyond the ambit or the spirit thereof.

We claim:

1. A hydraulic motor or pump mechanism comprising:

a cam;

a cylinder block mounted to rotate relative to the cam about an axis of rotation;

at least one cylinder formed in the cylinder block;

at least as many pistons as there are cylinders, each position being slidably mounted inside a cylinder along a piston slide axis and having a top portion situated opposite to the axis of rotation;

as many piston thrust rollers for rolling on the cam as there are pistons, each roller being axially defined by two transverse end faces and being mounted on a piston via a rotary bearing to rotate about a roller axis perpendicular to the sliding axis of said piston, the roller being suitable for penetrating, at least in part, into the cylinder in which the piston is slidably mounted, an end of the piston in which the rotary bearing is mounted including two recesses each corresponding to at least one space extending between at least a cylindrical surface of the roller, a cylindrical surface of the cylinder in which the piston is slidably mounted, and one of the transverse faces of the roller, said space being open to the top portion of the piston at least in a zone where the cylindrical surface of the roller is disposed projecting beyond the piston; and two wedging parts for each roller, each of which parts is disposed in one of said two recesses between the corresponding end face of the roller and an inside face of the cylinder on which said wedging parts bears, so as to hold the roller in position axially parallel to it axis of rotation while firstly at least one of the two wedging parts extends on the axis of the piston as far as the bottom portion of the recess so that in the direction of the piston leaving the cylinder it is displaced together with said piston, and secondly said wedging part includes a groove which extends parallel to the axis of the piston and which opens out into a face of said wedging part opposite from the corresponding end face of the roller, a projection that is fixed relative to the cylinder, and that is disposed projecting into said cylinder, being inserted in said groove so as to leave said wedging part free to move in translation relative to the cylinder parallel to the piston slide axis;

wherein a hole provided in the cylinder block opens out into a peripheral face thereof, while a part that is generally U-shaped having a first branch and a second branch interconnected by a web of the U-shaped part is mounted on the cylinder block by inserting said first branch in said hole and by fixing said first branch relative to the cylinder block by fixing means, said second branch being inserted into the groove included in said wedging part and constituting said projection, said web of the U-shaped part being placed over said periphery of the cylinder block.

2. A mechanism according to claim 1, wherein the first branch of the U-shaped part possesses, prior to insertion in the hole of the cylinder block, a determined transverse dimension that is greater than the direction of said hole in a determined transverse direction, said fixing means being constituted by a clamping that exists between the first branch and the wall of the hole after insertion of said first branch in the hole which puts said determined transverse dimension of the first branch of the U-shaped part substantially into coincidence with said determined transverse direction of the hole.

3. A mechanism according to claim 2, wherein the first branch of the U-shaped part is in the form of an open ring and is made of a resilient material, one of the transverse dimensions of the ring, prior to its insertion in the hole of the cylinder block, constituting said determined transverse dimension.

4. A mechanism according to claim 3, wherein said ring is made of metal.

5. A mechanism according to claim 2, wherein the first branch of the U-shaped part is provided with teeth whose ends coincide with said determined transverse dimension, and having the function of securing said first branch in the wall of said hole.

6. A mechanism according to claim 5, wherein the first branch of the U-shaped part is shaped as a plane strip defined by two opposite edges each provided with said teeth.

7. A mechanism according to claim 2, wherein the first branch of the U-shaped part includes a core and a core-covering body made of a material having a small modulus of elasticity relative to modulus of elasticity of the cylinder block and of the core.

8. A mechanism according to claim 7, wherein the modulus of elasticity of said material is not greater than 10,000 mega Pascals.

9. A mechanism according to claim 7, wherein said core is shaped as a plane strip defined by two opposite edges, each edge being provided with indentations for securing said core-covering body.

10. A mechanism according to claim 7, wherein said hole is cylindrical having an axis that is substantially radial relative to the axis of rotation of the cylinder block and of determined diameter, and wherein said body is likewise substantially cylindrical and possesses a diameter which, prior to insertion of the first branch of the U-shaped part into the hole is greater than the determined diameter of the hole.

11. A mechanism according to claim 9, wherein said hole is cylindrical having an axis that is substantially radial relative to the axis of rotation of the cylinder block and of determined diameter, and wherein said body is likewise substantially cylindrical and possesses a diameter which, prior to insertion of the first branch of the U-shaped part into the hole is greater than the determined diameter of the hole.

12. A mechanism according to claim 11, wherein the axis of the cylindrical hole lies in the radial plane containing the axis of rotation of the cylinder block and the sliding axis of the piston.

13. A mechanism according to claim 1, wherein said hole is cylindrical, its axis being substantially radial relative to the axis of rotation of the cylinder block.

14. A mechanism according to claim 13, wherein the axis of the cylindrical hole lies in the radial plane containing the axis of rotation of the cylinder block and the sliding axis of the piston.

* * * * *